US006360675B1

(12) United States Patent
Jones

(10) Patent No.: US 6,360,675 B1
(45) Date of Patent: Mar. 26, 2002

(54) ADJUSTABLE TABLE CORD STORAGE ASSEMBLY

(75) Inventor: Steven D. Jones, E. Grand Rapids, MI (US)

(73) Assignee: Suspa Incorporated, Grand Rapids, MI (US)

( * ) Notice: Subject to any disclaimer, the term of this patent is extended or adjusted under 35 U.S.C. 154(b) by 0 days.

(21) Appl. No.: 09/573,144

(22) Filed: May 17, 2000

(51) Int. Cl.[7] ..... A47B 37/00
(52) U.S. Cl. ..... 108/50.02
(58) Field of Search ..... 108/50.01, 50.02, 108/20, 23; 312/223.6, 195; 100/147

(56) References Cited

U.S. PATENT DOCUMENTS 909,547 A * 1/1909 Clark ..... 108/50.02
1,184,539 A * 5/1916 Kendelhardt ..... 108/50.02 X
4,500,150 A * 2/1985 Leibensperger et al. . 108/50.02 X
4,544,214 A * 10/1985 Nizel et al. ..... 312/228 X
4,852,500 A * 8/1989 Ryburg et al. ..... 108/50.02 X
5,078,414 A * 1/1992 Court et al. ..... 108/50.01 X
5,259,326 A * 11/1993 Borgman et al. ..... 108/147
5,322,025 A * 6/1994 Sherman et al. ..... 108/147
5,988,076 A * 11/1999 Vander Park ..... 108/50.02
6,095,156 A * 8/2000 Smith, II ..... 312/223.6 X

FOREIGN PATENT DOCUMENTS

GB 709433 * 5/1954 ..... 312/223.6

* cited by examiner

*Primary Examiner*—Jose V. Chen
(74) *Attorney, Agent, or Firm*—Price, Heneveld, Cooper, DeWitt & Litton

(57) ABSTRACT

A housing which includes a cable take-up reel is mounted to the underside of a work surface for storing excess cords or cables employed to control an adjustable height table. In one embodiment, the housing is a motor control which integrally includes a toroidal transformer covered by a cylindrical body extending downwardly from the housing and which forms the drum of the take-up reel. A snap-fit flange extends over the end of the cylindrical body to hold cords in position once wrapped around the drum. A protective and decorative cover snap-fits over the motor control and take-up reel once the excess cord has been wrapped around the take-up reel for storage.

21 Claims, 3 Drawing Sheets

ADJUSTABLE TABLE CORD STORAGE ASSEMBLY

BACKGROUND OF THE INVENTION

The present invention relates to a movable leg assembly employed for controlling the height of a work surface and particularly a system for storing cords associated with the controls therefor.

As the work place environment changes with technology, so too do the facilities employed by companies to provide ergonomically appropriate work stations for technical, clerical, and assembly personnel. In order to accommodate different job tasks, frequently it is desirable to have a work surface which is vertically adjustable, such that the work surface can be employed by individuals in a standing position, in a sitting position on an office chair, or in an intermediate position when using, for example, a stool-height seat. With the ubiquitous use of personal computers, multiple adjustable table heights accommodate different individual needs for placing a monitor, for example, at a level which may be different than the writing surface or the work surface on which the computer controls are employed. There exists, therefore, an increasing need for a work surface which has an adjustable height and one which can be economically manufactured to provide desired movement and which esthetically blends with an office decor or other working environment.

There exists numerous adjustable table assemblies which are either mechanically controlled by, for example, a screw-jack mechanism or which are electrically controlled screw jacks. Some installations employ hydraulic cylinders with a pump for moving fluid from a master cylinder to slave cylinders mounted within telescopic legs of a table for controlling the vertical adjustment of the work surface.

With electrically driven systems, it is necessary to provide an operator control which is coupled, in turn, to a motor control unit typically utilizing an electrical connecting cord. The motor control unit, in turn, is coupled to individual drive motor assemblies through both signal cords and power transmitting cords. As a result, a myriad of electrical cords are employed, typically positioned under the work surface of a table for interconnecting the various drive and control elements utilized in connection with an electrically adjustable table. Such control units typically have standard cable lengths. Depending upon the size of the work surface to which the adjustable table mechanism is coupled, frequently an excess length of power or signal cords must be accommodated. This has been achieved by cutting and reconnecting plugs to the cords or by shortening the cords by splicing. These alternatives are costly and time consuming and may lead to failure of the system due to a bad connection.

There exists a need, therefore, for a cord management system which allows the use of existing standard cord lengths for motor controllers, motor actuating units, and remote control units which do not require the costly time-consuming cutting and splicing of cords to provide a universal length for motor-driven adjustable tables which may have different sized work surfaces and, therefore, different spacing for the various interconnected electrical units.

SUMMARY OF THE INVENTION

The system of the present invention accommodates for excess cord lengths, which may vary from installation to installation, by providing a housing which includes a cord take-up reel mounted thereto for storing excess cord which may exist. In one embodiment of the invention, the housing comprises a motor control assembly for an electrically controlled system. In one embodiment, the motor control assembly includes a toroidal transformer and the housing has a cylindrical body extending downwardly from the housing and which forms a drum of the take-up reel. In the preferred embodiment of the invention also, a snap-fit flange extends over the end of the drum to hold cords in position once wrapped around drum. In a preferred embodiment of the invention, a protective and decorative cover snap-fits over the motor control and take-up reel once the excess cord has been wrapped around the take-up reel for storage. With such a system, the excess length of cords which exist in many adjustable table installations are accommodated without the addition of any noticeable structure by the utilization of a take-up reel in a covered housing. Such construction provides a low cost, economical, and esthetically desirable solution to the problem of excess cord management and can be used in addition for systems in which small flexible hydraulic lines are employed in place of cords or flexible mechanical cables are employed for purely mechanical adjustment systems.

These and other features, objects and advantages of the present invention will become apparent upon reading the following description thereof together with reference to the accompanying drawings.

DETAILED DESCRIPTION OF THE PREFERRED EMBODIMENT

Figure 1:
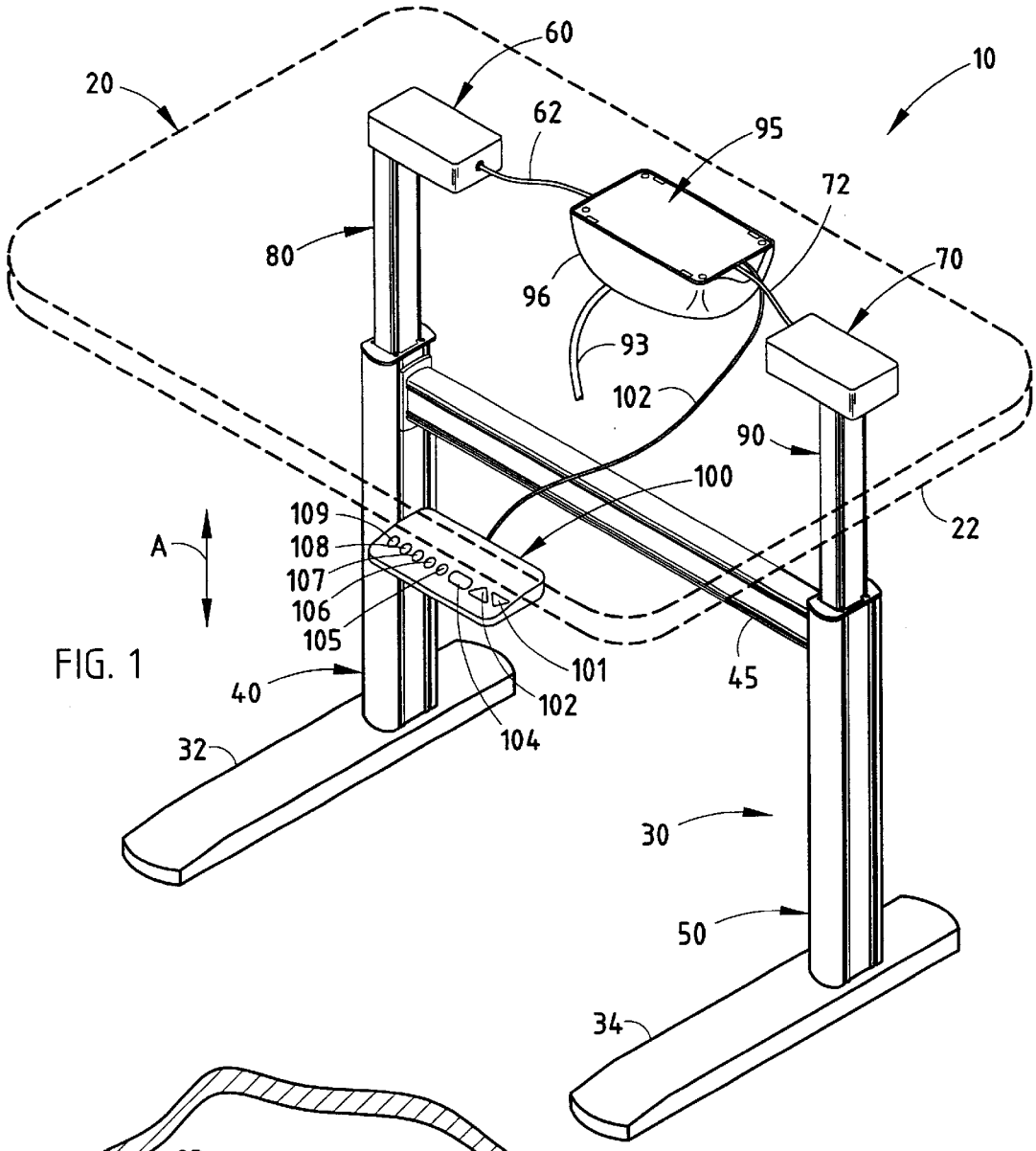
FIG. 1 is a perspective view of a table embodying the present invention, shown partly in phantom form.

Referring initially to FIG. 1, there is shown an adjustable table assembly 10 of the present invention, which includes a generally rectangular, horizontally extending work surface coupled to a base 30 including a pair of horizontally extending feet 32 and 34 to which there is mounted vertically extending base legs 40 and 50 in spaced relationship to one another and coupled by a cross member 45. The work surface may be of any conventional material, such as a laminated composite board, solid wood, polymeric material, glass, or the like. Mounted to the underside 22 of work surface 20 are a pair of motor actuating assemblies 60 and 70, each of which are substantially identical. Assemblies 60 and 70 each include a low profile housing enclosing an electrical drive motor and right angle drive which is coupled to a screw jack, which couples to a thrust nut mounted in each of the legs 40 and 50, respectively.

Telescopic leg assemblies 80 and 90 couple the motor actuating assemblies 60 and 70 to base legs 40 and 50, respectively, and extend within the base legs when retracted and out of the legs when extended as the work surface height is adjusted in a vertical direction as indicated by arrow A in FIG. 1. Each of the motor actuating assemblies 60 and 70 is coupled to a motor control 95 also mounted to the underside 22 of work surface 20 by means of a conductor or cord 62 for actuator 60 and 72 for actuator 70. Conductors 62, 72 are signal and power control conductors, respectively.

The motor control 95 is coupled to an operator control 100 by means of a conductor or cord 102. Operator control 100 is mounted to the front underside edge of surface 22 such that the operator control switches are conveniently accessible. Operator control 100 includes a plurality of switches such as a down control touch switch 101, an up control touch switch 102, a digital display 104 displaying a digital number representing the height level of work surface and memory position switches 105 through 109. An AC power cord 93 having a conventional electrical plug (not shown) is coupled to a wall outlet for supplying operating power to the motor control 95 which, in turn, converts the input power to the desired operating voltages for motors contained within actuators 60 and 70 in response to commands from operator control 100 through motor control 95. Motor control 95 includes a microprocessor programmed to receive signals representing the position of the telescopic leg assemblies 80 and 90 such that certain frequently used or desired positions can be stored in memory and, by actuating one of the preset switches 105–109, the table surface can be moved to the desired position in response to an input command signal. Although the table shown in FIG. 1 is a two-pedestal table, it can be appreciated that the present invention can be employed with single pedestal tables, tables having three or more legs or dual section tables with front and rear work surfaces.

In the preferred embodiment of the invention, the actuators 60 and 70 are electrically driven screw jacks driven by DC controlled, pulse-width modulated motors, although it should be appreciated that hydraulic or other actuators can be employed using telescopic leg assemblies 80 and 90 and interconnecting hydraulic lines or flexible cables. The table assembly 10 and the telescopic leg construction is described in greater detail in copending patent application entitled ADJUSTABLE LEG ASSEMBLY, Ser. No. 9/573,065, filed on even date herewith, the disclosure of which is incorporated herein by reference.

With either the electrical table control, as shown in FIG. 1, or hydraulic or mechanical controlled adjustable height work surfaces, frequently the electrical, hydraulic, or mechanical cords or cables employed have a preset length when provided from the supplier of the actuators utilized. As a result, some form of cord management is desired to keep the cords from drooping and interfering with the legs of a person utilizing the work surface, chairs, stools, or other objects which may be positioned under the work surface. In order to provide a management system for such excess cords, cables, and fluid lines, the storage assembly of the present invention is provided and is now described in greater detail in connection with FIGS. 2–5.

Figure 2:
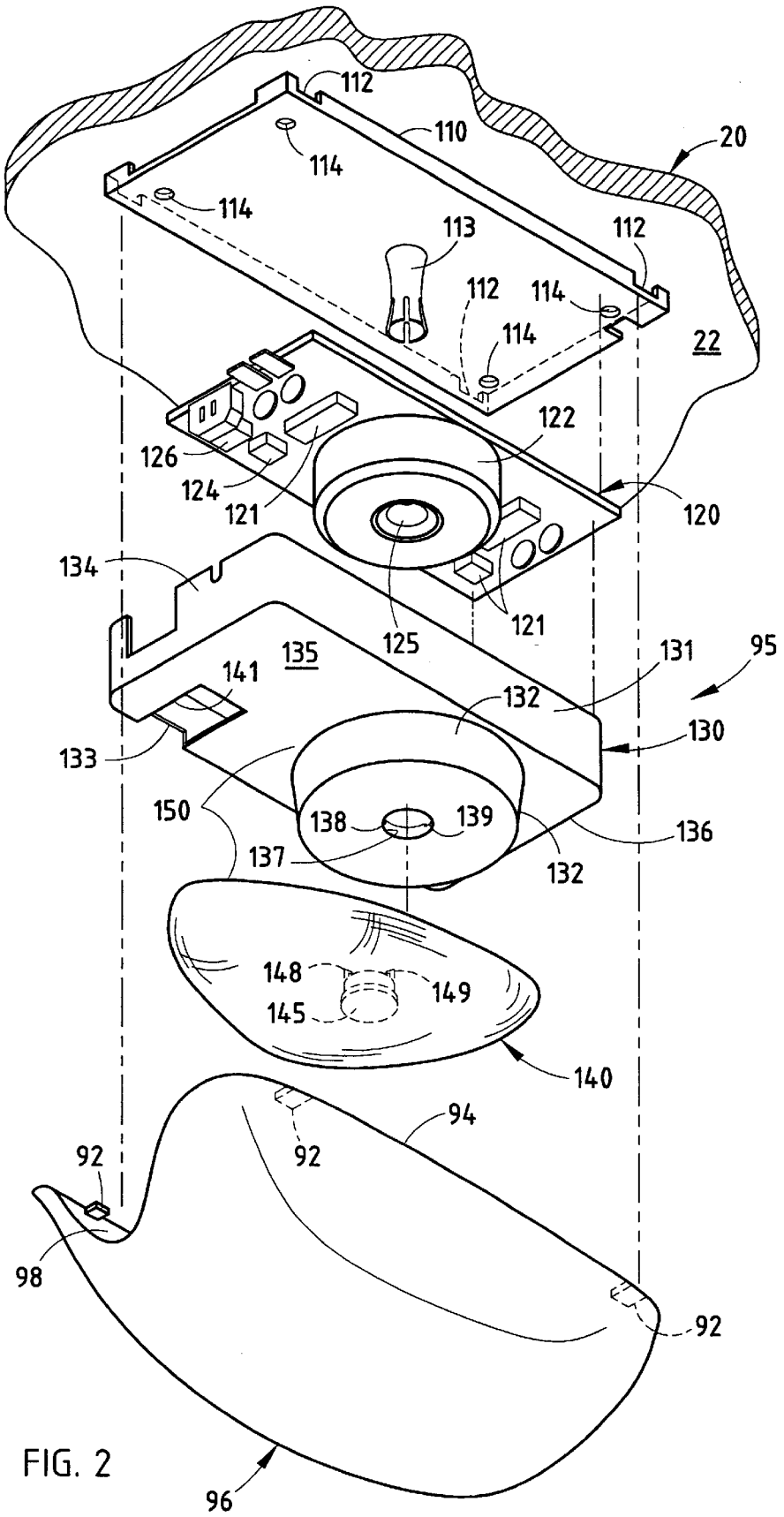
FIG. 2 is an exploded perspective view of the motor control assembly shown in FIG. 1.

Referring initially to FIG. 2, there is shown the motor control 95 in exploded form, together with the integrated cord reel of the present invention. Motor control 95 is mounted to the underside 22 of work surface 20 and includes a base plate 110 having mounting slots 112 spaced at four corners of the mounting plate for snap-receiving mounting tabs 92 of cover 96 as described in greater detail below. Plate 110 is suitably mounted to the underside of work surface 20 by fasteners extending through apertures 114. Typically, if the work surface is made of a drillable material, threaded fasteners will be employed for securing base plate 110 to the underside 22 of the work surface 20. Adhesive bonding may be employed if the work surface is of glass, granite, or other material typically not drilled for attaching items thereto.

Figure 3:
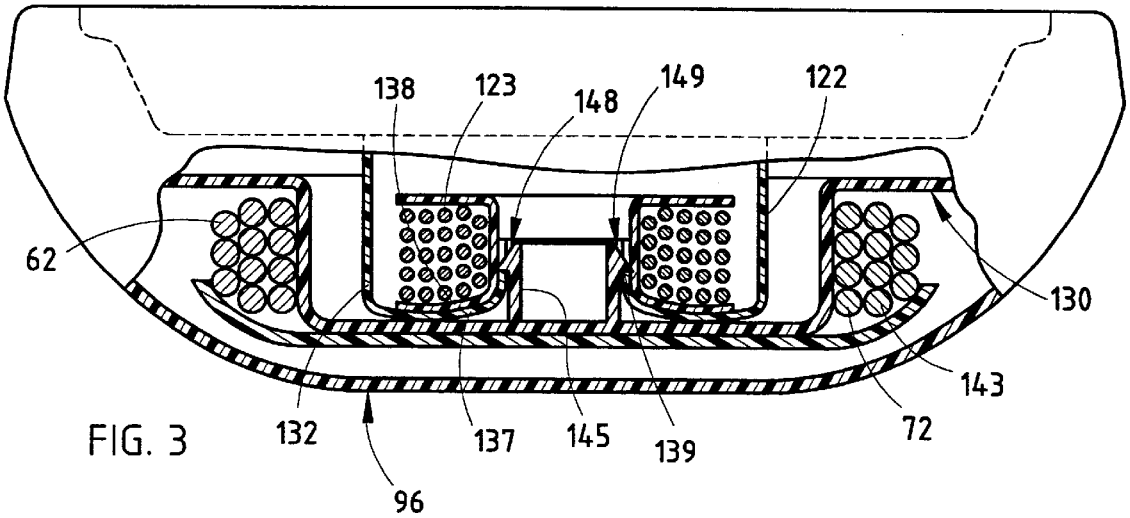
FIG. 3 is a partly cut-away vertical cross-sectional view of the motor control assembly shown in FIG. 1.

A circuit board 120 containing the various electric control elements for the control of motor actuators 60, 70 and for receiving signals from operator control 100 and the actuators is mounted to the base utilizing conventional fasteners and to which the various electrical cords are attached using Molex® connectors or other suitable electrical interconnection plugs and sockets for receiving the cords coupled to the actuators and operator control. Circuit board 120 also includes a toroidal transformer 122 having toroidal windings 123 as seen in FIG. 3 for minimizing electromagnetic interference which may otherwise emanate from a conventional transformer employed to reduce the line voltage from input conductor 93 to a usable level, which is subsequently rectified and filtered for use in providing power not only for the electrical components on board 120 but also the motor drive voltage employed with motor actuators 60, 70. The toroidal transformer 122 is mounted to a post 113 extending from plate 110 and projects downwardly somewhat, as seen in FIGS. 2 and 3, from the overall geometry of board 120, which includes a variety of conventional electrical components, such as a microprocessor 121 and digital circuits 124. A component cover 130 accommodates the toroidal transformer 122 by providing a cylindrical body 132 forming the drum of the take-up reel of the present invention and which extends downwardly from the lower surface 135 of the generally rectangular cover having side walls 131 and 133 and end walls 134 and 136 which substantially overlay and cover the circuit board 120 and is attached thereto by conventional fasteners. A removable cover (not shown) is provided over an aperture 141 in cover 130 to gain access to programmable interconnecting links, shown schematically at 126 on board 120, for programming for different operating voltages such that the motor control can be used by with either 220 or 110 VAC and 50 or 60 cycles, respectively.

Figure 4:
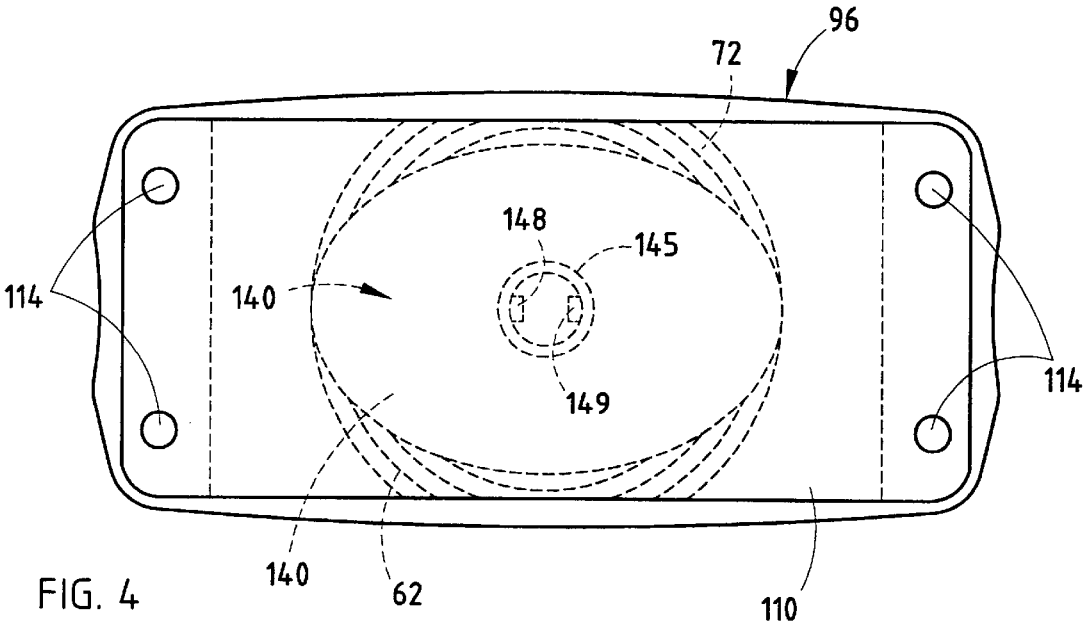
FIG. 4 is a top plan view of the assembly shown in FIG. 3, shown partly in phantom form.

The toroidal transformer 122 includes a central opening 125 which receives a cylindrical wall 137 of cover 130. Wall 137 has a pair of opposed 180° spaced-apart slots 138 and 139 formed therein for receiving mounting tabs 148 and 149, respectively, of a cylindrical extension 145 of reel flange 140 which snaps over drum 132 and provides a cord holding function as best seen in FIGS. 3 and 4.

The reel flange 140 is generally a concave, elliptical member made of a polymeric material, such as PET, ABS, PVC, or other suitable material, as is cover 130. Flange 140 integrally includes an upwardly extending cylindrical mounting post 145, as best seen in FIG. 3, which includes a pair of outwardly projecting locking tabs 148, 149, which fit within the diameter of cylindrical wall 137 of cover 130 with the tapered ends of tabs 148, and 149 sliding along the inner surface 137 until the ends snap to fit within slots 138 and 139, as seen in FIG. 3, to snap-fit reel flange 140 to the drum 132. The mounting reel 150 so-formed provides a take-up reel for excess cords, such as cords 62 and 72, as illustrated in FIG. 3, holding the cords between the outer cylindrical surface of drum 132 and the undersurface 143 of flange 140. By taking advantage of the toroidal shape of the transformer contained on the circuit board and the subsequent cylindrical drum 132 formed on the cover, a cord take-up reel is integrally formed with the motor control 95 for storing excess cords thereon.

Figure 5:
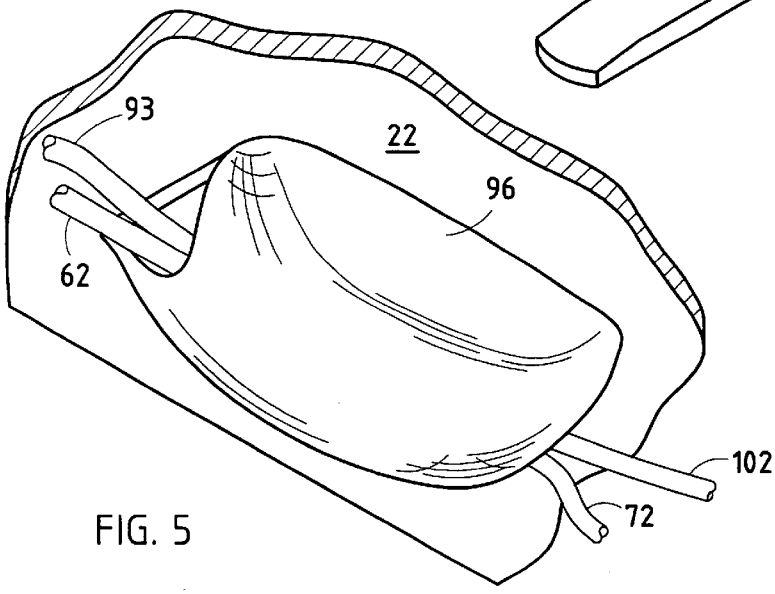
FIG. 5 is an enlarged perspective view of the motor control assembly taken from the underside of the table shown in FIG. 1.

Once any excess cord or cable, either the cable 62, 72, 93, or 102, has been wrapped around the drum 132 under flange 140, a flexible polymeric cover 96 is snap-fitted over base plate 110 by the flexing of the generally rectangular elongated cover 96 and subsequently snapping the side walls 94 and 98 inwardly such that tabs 92 engage slots 112 for holding the decorative outer cover 96 to the base plate 110 and underside 22 of work surface 20, as best seen in FIG. 5. Cover 96 can be made of the same polymeric material and injection molded as can be flange 140 and circuit board cover 130 with a material which is suitable for the environment of the work surface.

The cords are wound around the drum 132 of the power take-up reel 150 such that there is little or no slack in the cords and no further attachment to the underside 22 of the work surface is necessary since they will not extend downwardly a distance any greater than the distance of the actuators 60, 70 or the control 100.

Thus, with the cord take-up assembly 150 of the present invention, the excess cords, electrical cords, mechanical cables, or hydraulic fluid lines, if a hydraulic actuator system is employed, can be conveniently stored on the underside of the work surface to allow for the use of universal length interconnecting cords, cables, or lines for accommodating different sized and configured work surfaces where the spacing between, for example, the motor control 95 and the actuators 60, 70 may vary from table to table, as can the distance between operator control 100 and motor control 95. The system of the preferred embodiment takes advantage of the cylindrical toroidal transformer extension from the circuit board 120 by providing a conforming cover which defines a drum for the take-up reel. The take-up reel is esthetically covered by a snap-fit cover providing a trim appearance to the installation, as seen in FIGS. 1 and 5.

It will become apparent to those skilled in the art that various modifications to the preferred embodiment of the invention as described herein can be made without departing from the spirit or scope of the invention as defined by the appended claims.

The invention claimed is:

1. A cord storage system for an electrically controlled, vertically adjustable table comprising:

a table surface;

at least one motor-driven adjustable leg assembly coupled to said table surface;

at least one motor assembly coupled to said leg;

a motor control mounted to an underside of said table surface;

at least one electrical cord coupled between said motor control and said motor assembly; and a cord take-up reel mounted to an underside of said table surface for storing excess lengths of cord extending between said motor control and said motor assembly, said cord take-up reel including a central body with an end spaced from the underside of said table surface and a flange mounted to said body to retain a cord wound on said body.

2. The storage system as defined in claim 1 and further including a cover extending over said cord take-up reel.

3. A cord storage system for an electrically controlled, vertically adjustable table comprising:

a table surface;

at least one motor-driven adjustable leg assembly coupled to said table surface;

at least one motor assembly coupled to said leg;

a motor control mounted to an underside of said table surface;

at least one electrical cord coupled between said motor control and said motor assembly; and a cord take-up reel mounted to one of said motor control and motor assembly for storing excess lengths of cord extending between said motor control and said motor assembly, wherein said cord take-up reel comprises a generally cylindrical body having an end spaced from the underside of said table surface and a flange mounted to said end of said cylindrical body and extending beyond the diameter of said cylindrical body to retain a cord wound on said cylindrical body.

4. The storage system as defined in claim 3 wherein said generally cylindrical body is integrally formed on a downwardly facing surface of said motor control.

5. The storage system as defined in claim 4 wherein said generally cylindrical body and said flange include snap fittings to allow said flange to be snap-fitted to said cylindrical body.

6. The storage system as defined in claim 5 wherein said motor control includes a toroidal transformer and said generally cylindrical body surrounds said transformer.

7. The storage system as defined in claim 6 wherein one of said generally cylindrical body and flange includes mounting slots and the other of said generally cylindrical body and flange includes mounting tabs.

8. A cord storage system for a vertically adjustable table comprising:

a table surface;

at least one adjustable leg coupled to said table surface;

at least one assembly coupled to said leg for extending and contracting said leg;

a control mounted to an underside of said table surface and coupled to said assembly;

at least one elongated control element coupled between said control and said assembly; and a take-up reel mounted to an underside of said table surface and to one of said control and assembly for storing excess length of said control element extending between said control and said assembly, wherein said take-up reel comprises a central body having an end spaced from the underside of said table surface and a flange mounted to said end of said body to retain a control element wound on said central body.

9. The storage system as defined in claim 8 and further including a cover extending over said take-up reel.

10. A cord storage system for a vertically adjustable table comprising:

a table surface;

at least one adjustable leg coupled to said table surface;

at least one assembly coupled to said leg for extending and contracting said leg;

a control mounted to an underside of said table surface and coupled to said assembly;

at least one elongated control element coupled between said control and said assembly; and a take-up reel mounted to one of said control and assembly for storing excess length of said control element extending between said control and said assembly, wherein said take-up reel comprises a generally cylindrical body having an end spaced from the underside of said table surface and a flange mounted to said end of said cylindrical body and extending beyond the diameter of said cylindrical body to retain a control element wound on said cylindrical body.

11. The storage system as defined in claim 10 wherein said generally cylindrical body and said flange include snap fittings to allow said flange to be snap-fitted to said cylindrical body.

12. The storage system as defined in claim 11 and further including a cover extending over said take-up reel.

13. A cord storage system for an electrically controlled, vertically adjustable table comprising:

a table surface;

a pair of spaced-apart adjustable legs coupled to said table surface;

a motor assembly coupled to each of said legs;

a motor control mounted to an underside of said table surface;

an electrical cord coupled between said motor control and each of said motor assemblies; and a cord take-up reel mounted to said motor control for storing excess lengths of cord extending between said motor control and said motor assemblies, wherein said cable take-up reel comprises a central body having an end spaced form the underside of said table surface and a flange on said end of said body to retain a cord wound on said central body.

14. The storage system as defined in claim 13 and further including a cover extending over said cable take-up reel.

15. The storage system as defined in claim 14 wherein said motor control is positioned between said legs.

16. A cord storage system for an electrically controlled, vertically adjustable table comprising:

a table surface;

a pair of spaced-apart adjustable legs coupled to said table surface;

a motor assembly coupled to each of said legs;

a motor control mounted to an underside of said table surface between said legs;

an electrical cord coupled between said motor control and each of said motor assemblies;

a cord take-up reel mounted to said motor control for storing excess lengths of cord extending between said motor control and said motor assemblies, wherein said cable take-up reel comprises a generally cylindrical body having an end spaced from the underside of said table surface and a flange on said end of said cylindrical body and extending beyond the diameter of said cylindrical body to retain a cord wound on said cylindrical body; and a cover extending over said cable take-up reel.

17. The storage system as defined in claim 16 wherein said motor control includes a housing and said take-up reel is integrally formed on said housing.

18. The storage system as defined in claim 17 wherein said housing is made of a resilient polymeric material.

19. The storage system as defined in claim 18 wherein said generally cylindrical body and said flange are separate elements which include snap fittings to allow said flange to be snap-fitted to said cylindrical body.

20. The storage system as defined in claim 19 wherein said motor control includes a toroidal transformer and said generally cylindrical body surrounds said transformer.

21. The storage system as defined in claim 20 wherein one of said generally cylindrical body and flange includes mounting slots and the other of said generally cylindrical body and flange includes tabs.

* * * * *